US006665637B2

(12) United States Patent
Bruhn

(10) Patent No.: US 6,665,637 B2
(45) Date of Patent: Dec. 16, 2003

(54) ERROR CONCEALMENT IN RELATION TO DECODING OF ENCODED ACOUSTIC SIGNALS

(75) Inventor: Stefan Bruhn, Sollentuna (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 35 days.

(21) Appl. No.: 09/982,028

(22) Filed: Oct. 19, 2001

(65) Prior Publication Data

US 2002/0072901 A1 Jun. 13, 2002

(30) Foreign Application Priority Data

Oct. 20, 2000 (EP) ..... 00850171

(51) Int. Cl.[7] ..... G10L 11/04; G10L 13/06

(52) U.S. Cl. ..... 704/206; 704/205; 704/207; 704/208; 704/209; 704/200.1; 704/268; 704/220

(58) Field of Search ..... 704/200.1, 201, 704/205, 206, 207, 208, 219, 220–223, 258, 262–266, 268, 209

(56) References Cited

U.S. PATENT DOCUMENTS

| | | | | | |
|---|---|---|---|---|---|
| 4,752,956 | A | * | 6/1988 | Sluijter | 704/219 |
| 5,479,168 | A | * | 12/1995 | Johnson et al. | 341/110 |
| 5,598,506 | A | | 1/1997 | Wigren et al. | |
| 5,630,011 | A | * | 5/1997 | Lim et al. | 704/205 |
| 5,699,485 | A | * | 12/1997 | Shoham | 704/223 |
| 5,701,390 | A | * | 12/1997 | Griffin et al. | 704/206 |
| 5,717,822 | A | * | 2/1998 | Chen | 704/219 |
| 5,907,822 | A | * | 5/1999 | Prieto, Jr. | 704/202 |
| 5,909,663 | A | | 6/1999 | Iijima et al. | |
| 6,041,297 | A | * | 3/2000 | Goldberg | 704/219 |
| 6,327,562 | B1 | * | 12/2001 | Proust | 704/219 |
| 6,377,915 | B1 | * | 4/2002 | Sasaki | 704/206 |
| 6,408,267 | B1 | * | 6/2002 | Proust | 704/210 |
| 6,424,939 | B1 | * | 7/2002 | Herre et al. | 704/219 |

FOREIGN PATENT DOCUMENTS

| | | |
|---|---|---|
| EP | 0655161 B1 | 5/1995 |
| EP | 0673017 A | 9/1995 |
| EP | 0718982 A | 6/1996 |
| FR | 2774827 | 8/1999 |
| WO | WO94/29850 | 12/1994 |

OTHER PUBLICATIONS

Fingscheidt et al., ("Robust speech decoding : can error concealment be better than error correction ?", Proceedings of the 199 IEEE International Conference on Acoustics, Speech, and Signal Processing 1998. ICASSP'98. vol. 1, pp. 373–376).*

Nafie et al., ("Implementation of recovery of speech with missing samples on a DSP chip", Electronics letters, vol. 30, issue 1, Jan. 6, 1994, pp. 12–13).*

Estrada et al., ("Forward error for CELP encoded speech", 1996 Conference of the Thirtieth Asilomar Conference on Signals, Systems and Computers, 1996, vol. 1, pp. 775–778).*

Kain et al., ("Stochastic modeling of spectral adjustment for high quality pitch modification", Proceedings, 2000 IEEE International Conference on Acoustics, Speech and Signal Processing 2000, ICASSP'00, vol. 2, pp. II949–II952).*

(List continued on next page.)

*Primary Examiner*—Vijay Chawan
(74) *Attorney, Agent, or Firm*—Burns, Doane, Swecker & Mathis, L.L.P.

(57) ABSTRACT

The present invention relates to the concealment of errors in decoded acoustic signals caused by encoded data representing the acoustic signals being partially lost or damaged during transmission over a transmission medium. In case of lost data or received damaged data a secondary reconstructed signal is produced on basis of a primary reconstructed signal. This signal has a spectrally adjusted spectrum ($Z_4^E$), such that it deviates less with respect spectral shape from a spectrum ($Z_3$) of a previously reconstructed signal produced from previously received data than a spectrum ($Z'_4$) of the primary reconstructed signal.

67 Claims, 3 Drawing Sheets

OTHER PUBLICATIONS

Chang et al: "Block Loss Recovery Using Sequential Projections Onto The Feature Vectors"; IEICE Trans. Fundamentals, vol. E80–A, No. 9, Sep. 9, 1997, pp. 1714–1720.

Colin Perkins et al.: "A Survey of Packet–Loss Recovery Techniques for Streaming Audio"; Dept. of Computer Science, University College London, UK; Aug. 10, 1998, pp. 1–15.

* cited by examiner

ERROR CONCEALMENT IN RELATION TO DECODING OF ENCODED ACOUSTIC SIGNALS

THE BACKGROUND OF THE INVENTION AND PRIOR ART

The present invention relates generally to the concealment of errors in decoded acoustic signals caused by encoded data representing the acoustic signals being partially lost or damaged. More particularly the invention relates to a method of receiving data in the form of encoded information from a transmission medium and an error concealment unit according to the preambles of claims 1 and 39 respectively. The invention also relates to decoders for generating an acoustic signal from received data in the form of encoded information according to the preambles of claims 41 and 42 respectively, a computer program according to claim 37 and a computer readable medium according to claim 38.

There are many different applications for audio and speech codecs (codec=coder and decoder). Encoding and decoding schemes are, for instance, used for bit-rate efficient transmission of acoustic signals in fixed and mobile communications systems and in videoconferencing systems. Speech codecs can also be utilised in secure telephony and for voice storage.

Particularly in mobile applications, the codecs occasionally operate under adverse channel conditions. One consequence of such non-optimal transmission conditions is that encoded bits representing the speech signal are corrupted or lost somewhere between the transmitter and the receiver. Most of the speech codecs of today's mobile communication systems and Internet applications operate block-wise, where GSM (Global System for Mobile communication), WCDMA (Wideband Code Division Multiple Access), TDMA (Time Division Multiple Access) and IS95 (International Standard-95) constitute a few examples. The block-wise operation means that an acoustic source signal is divided into speech codec frames of a particular duration, e.g. 20 ms. The information in a speech codec frame is thus encoded as a unit. However, usually the speech codec frames are further divided into sub-frames, e.g. having a duration of 5 ms. The sub-frames are then the coding units for particular parameters, such as the encoding of a synthesis filter excitation in the GSM FR-codec (FR=Full Rate), GSM EFR-codec (EFR=Enhanced Full Rate), GSM AMR-codec (AMR=Adaptive Multi Rate), ITU G.729-codec (ITU=International Telecommunication Union) and EVRC (Enhanced Variable Rate Codec).

Besides the excitation parameters, the above codecs also model acoustic signals by means of other parameters like, for instance, LPC-parameters (LPC=Linear Predictive Coding), LTP-lag (LTP=Long Term Prediction) and various gain parameters. Certain bits of these parameters represent information that is highly important with respect to the perceived sound quality of the decoded acoustic signal. If such bits are corrupted during the transmission the sound quality of the decoded acoustic signal will, at least temporarily, be perceived by a human listener as having a relatively low quality. It is therefore often advantageous to disregard the parameters for the corresponding speech codec frame if they arrive with errors and instead make use of previously received correct parameters. This error concealment technique is applied, in form or the other, in most systems through which acoustic signals are transmitted by means of non-ideal channels.

The error concealment method normally aims at alleviating the effects of a lost/damaged speech codec frame by freezing any speech codec parameters that vary comparatively slowly. Such error concealment is performed, for instance, by the error concealment unit in the GSM EFR-codec and GSM AMR-codec, which repeats the LPC-gain and the LPC-lag parameters in case of a lost or damaged speech codec frame. If, however, several consecutive speech codec frames are lost or damaged various muting techniques are applied, which may involve repetition of gain parameters with decaying factors and repetition of LPC-parameters moved towards their long-term averages. Furthermore, the power level of the first correctly received frame after reception of one or more damaged frames may be limited to the power level of the latest correctly received frame before reception of the damaged frame(s). This mitigates undesirable artefacts in the decoded speech signal, which may occur due to the speech synthesis filter and adaptive codebook being set in erroneous states during reception of the damaged frame(s).

Below is referred to a few examples of alternative means and aspects of ameliorating the adverse effects of speech codec frames being lost or damaged during transmission between a transmitter and a receiver.

The U.S. Pat. No. 5,907,822 discloses a loss tolerant speech decoder, which utilises past signal-history data for insertion into missing data segments in order to conceal digital speech frame errors. A multi-layer feed-forward artificial neural network that is trained by back-propagation for one-step extrapolation of speech compression parameters extracts the necessary parameters in case of a lost frame and produces a replacement frame.

The European patent, B1, 0 665 161 describes an apparatus and a method for concealing the effects of lost frames in a speech decoder. The document suggests the use of a voice activity detector to restrict updating of a threshold value for determining background sounds in case of a lost frame. A post filter normally tilts the spectrum of a decoded signal. However, in case of a lost frame the filtering coefficients of the post filter are not updated.

The U.S. Pat. No. 5,909,663 describes a speech coder in which the perceived sound quality of a decoded speech signal is enhanced by avoiding a repeated use of the same parameter at reception of several consecutive damaged speech frames. Adding noise components to an excitation signal, substituting noise components for the excitation signal or reading an excitation signal at random from a noise codebook containing plural excitation signals accomplishes this.

The known error concealment solutions for narrow-band codecs generally provide a satisfying result in most environments by simply repeating certain spectral parameters from a latest received undamaged speech codec frame during the corrupted speech codec frame(s). In practice, this procedure implicitly retains the magnitude and the shape of the spectrum of the decoded speech signal until a new undamaged speech codec frame is received. By such preservation of the speech signal's spectral magnitude and the shape, it is also implicitly assumed that an excitation signal in the decoder is spectrally flat (or white).

However, this is not always the case. An Algebraic Code Excited Linear Predictive-codec (ACELP) may, for instance, produce non-white excitation signals. Furthermore, the spectral shape of the excitation signal may vary considerably from one speech codec frame to another.

A mere repetition of spectral parameters from a latest received undamaged speech codec frame could thus result in abrupt changes in the spectrum of the decoded acoustic signal, which, of course, means that a low sound quality is experienced.

Particularly, wide-band speech codecs operating according to the CELP coding paradigm have proven to suffer from the above problems, because in these codecs the spectral shape of the synthesis filter excitation may vary even more dramatically from one speech codec frame to another.

SUMMARY OF THE INVENTION

The object of the present invention is therefore to provide a speech coding solution, which alleviates the problem above.

According to one aspect of the invention the object is achieved by a method of receiving data in the form of encoded information and decoding the data into an acoustic signal as initially described, which is characterised by, in case of received damaged data, producing a secondary reconstructed signal on basis of a primary reconstructed signal. The secondary reconstructed signal has a spectrum, which is a spectrally adjusted version of the spectrum of the primary reconstructed signal where the deviation with respect to spectral shape to a spectrum of a previously reconstructed signal is less than a corresponding deviation between the spectrum of the primary reconstructed signal and the spectrum of the a previously reconstructed signal.

According to another aspect of the invention the object is achieved by a computer program directly loadable into the internal memory of a computer, comprising software for performing the method described in the above paragraph when said program is run on the computer.

According to a further aspect of the invention the object is achieved by a computer readable medium, having a program recorded thereon, where the program is to make the computer perform the method described in the penultimate paragraph above.

According to still a further aspect of the invention the object is achieved by an error concealment unit as initially described, which is characterised in that, in case of received damaged data, a spectral correction unit produces a secondary reconstructed spectrum based on a primary reconstructed signal such that the spectral shape of the secondary reconstructed spectrum deviates less with respect to spectral shape from a spectrum of a previously reconstructed signal than a spectrum based on the primary reconstructed signal.

According to yet another aspect of the invention the object is achieved by a decoder for generating an acoustic signal from received data in the form of encoded information. The decoder includes a primary error concealment unit to produce at least one parameter. It also includes a speech decoder to receive speech codec frames, the at least one parameter from the primary error concealment and to provide in response thereto an acoustic signal. Furthermore, the decoder includes the proposed error concealment unit wherein the primary reconstructed signal constitutes the decoded speech signal produced by the speech decoder and the secondary reconstructed signal constitutes an enhanced acoustic signal.

According to still another aspect of the invention the object is achieved by a decoder for generating an acoustic signal from received data in the form of encoded information. The decoder includes a primary error concealment unit to produce at least one parameter. It also includes an excitation generator to receive speech codec parameters and the at least one parameter and to produce an excitation signal in response to the at least one parameter from the primary error concealment unit. Finally, the decoder includes the proposed error concealment unit wherein the primary reconstructed signal constitutes the excitation signal produced by the excitation generator and the secondary reconstructed signal constitutes an enhanced excitation signal.

The proposed explicit generation of a reconstructed spectrum as a result of lost or received damaged data ensures spectrally smooth transitions between periods of received undamaged data and periods of received damaged data. This, in turn, provides an enhanced perceived sound quality of the decoded signal, particularly for advanced broadband codecs, for instance, involving ACELP-coding schemes.

BRIEF DESCRIPTION OF THE DRAWINGS

The present invention is now to be explained more closely by means of preferred embodiments, which are disclosed as examples, and with reference to the attached drawings.

DESCRIPTION OF PREFERRED EMBODIMENTS OF THE INVENTION

Figure 1:
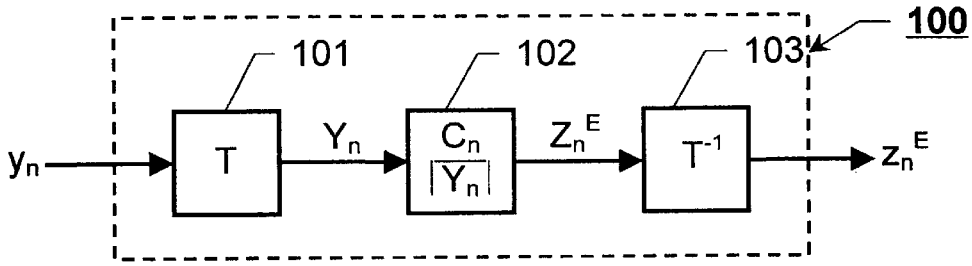
FIG. 1 shows a general block diagram over an error concealment unit according to the invention.

FIG. 1 shows a block diagram over an error concealment unit according to the invention. The object of the error concealment unit 100 is to produce an enhanced signal $Z_n^E$ decoded from received data in case the received data is damaged or lost. The enhanced decoded signal $Z_n^E$ either represents a parameter of a speech signal, such as an excitation parameter, or the enhanced decoded signal $Z_n^E$ itself is an acoustic signal. The unit 100 includes a first transformer 101, which receives a primary reconstructed signal $y_n$ being derived from the received data. The primary reconstructed signal $y_n$ is regarded as a signal in the time domain and the first transformer 101 regularly produces a primary reconstructed frequency transform $Y_n$ of a latest received time segment of the primary reconstructed signal $y_n$ in the form of a first spectrum. Typically, each segment corresponds to a signal frame of the received signal.

The first spectrum $Y_n$ is forwarded to a spectral correction unit 102, which produces a secondary reconstructed spectrum $Z_n^E$ on basis of the first spectrum $Y_n$. The secondary reconstructed spectrum $Z_n^E$ is produced such that it deviates less with respect to spectral shape from a spectrum of a previously reconstructed signal than a spectrum based on the primary reconstructed signal $y_n$.

Figure 2:
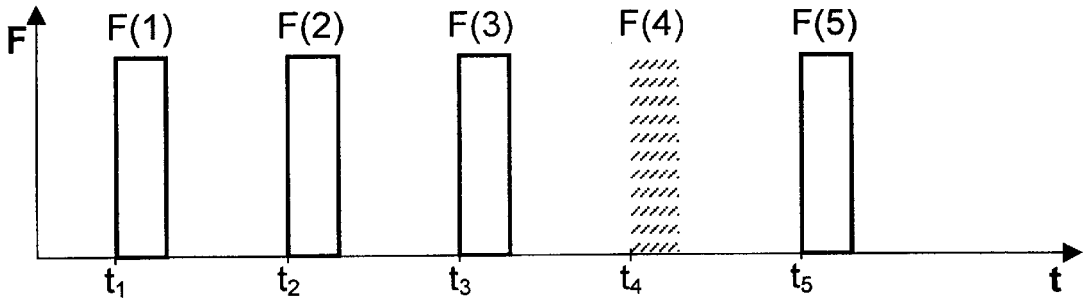
FIG. 2 shows a diagram over consecutive signal frames containing encoded information representing an acoustic signal.

In order to illustrate this, reference is made to FIG. 2, where consecutive signal frames F(1)–F(5) containing encoded information, which represents an acoustic signal are shown in a diagram. The signal frames F(1)–F(5) are produced by a transmitter at regular intervals $t_1$, $t_2$, $t_3$, $t_4$ respective $t_5$.

Nevertheless, it is not necessary that the signal frames F(1)–F(5) arrive with the same regularity to the receiver or even in the same order as long as they arrive within a sufficiently small delay so, as the receiver can re-arrange the signal frames F(1)–F(5) in the correct order before decoding. However, for reasons of simplicity, the signal frames F(1)–F(5) are in this example assumed arrive in a timely manner and in the same order as they were generated by the transmitter. The initial three signal frames F(1)–F(3) arrive undamaged, i.e. without any errors in the included information. The fourth signal frame F(4), however, is damaged, or possibly lost completely before reaching a decoding unit. The subsequent signal frame F(5) again arrives undamaged.

Figure 3:
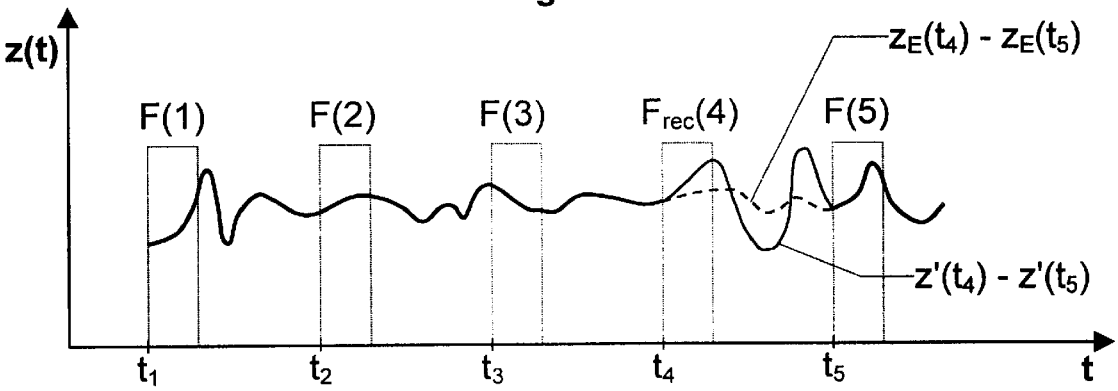
FIG. 3 shows a decoded acoustic signal based on the encoded information in the signal frames in FIG. 2.

FIG. 3 shows a decoded acoustic signal z(t) being based on the signal frames F(1)–F(5) in FIG. 2. An acoustic signal z(t) in the time domain t is generated on basis of information contained in the first signal frame F(1) between a first time instance $t_1$ and a second time instance $t_2$. Correspondingly, the acoustic signal z(t) is generated up to a fourth time instant $t_4$ based the information in the second F(2) and third F(3) signal frames. In a real case, there would also be shift between the intervals $t_1$–$t_5$ on the transmitter side and the corresponding time instances $t_1$–$t_5$ on the receiver side due to i.a. encoding delay, transmission time and decoding delay. Again, for simplicity, this fact has been ignored here.

Nevertheless, at the fourth time instant $t_4$ there exists no (or possibly only unreliable) received information to base the acoustic signal z(t) upon. Therefore, the acoustic signal $z'(t_4)$–$z'(t_5)$ is based on a reconstructed signal frame $F_{rec}$(4) produced by a primary error concealment unit between the fourth time instant $t_4$ and a fifth time instant $t_5$. As illustrated in the FIG. 3 the acoustic signal z(t) derived from the reconstructed signal frame $F_{rec}$(4) exhibits different waveform characteristics than the parts of the acoustic signal z(t) derived from the adjacent signal frames F(3) and F(5).

Figure 4:
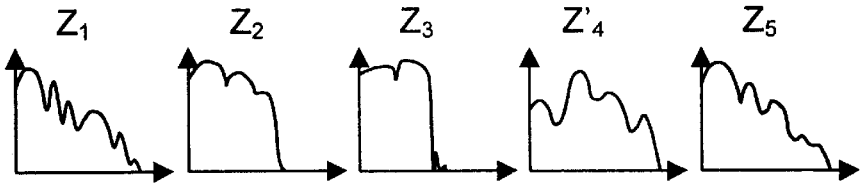
FIG. 4 shows a set of spectra for segments of the decoded acoustic signal in FIG. 3 corresponding to the signal frames in FIG. 2.

FIG. 4 shows a set of spectra $Z_1$, $Z_2$, $Z_3$, $Z'_4$ and $Z_5$, which correspond to the respective segments $z(t_1)$–$z(t_2)$, $z(t_2)$–$z(t_3)$, $z(t_3)$–$z(t_4)$ and $z'(t_4)$–$z'(t_5)$ of the decoded acoustic signal z(t) in FIG. 3. The decoded acoustic signal z(t) is comparatively flat in the time domain t between the third time instance $t_3$ and the fourth time instance $t_4$ and therefore has a relatively strong low frequency content, which is represented by a corresponding spectrum $Z_3$ having the majority of its energy located in the low-frequency region. In contrast to this, the spectrum of the acoustic signal $z'(t_4)$–$z'(t_5)$ based on the reconstructed signal frame $F_{rec}$(4) contains considerably more energy in the high-frequency band and the signal $z'(t_4)$–$z'(t_5)$ in the time domain t shows relatively fast amplitude variations. The contrasting spectral shapes of the spectrum $Z_3$ of the decoded acoustic signal based on the latest received undamaged signal frame F(3) and the spectrum $Z'_4$ of the decoded acoustic signal based on the reconstructed signal frame $F_{rec}$(4) leads to undesired artefacts in the acoustic signal and a human listener perceives a low sound quality.

Figure 5:
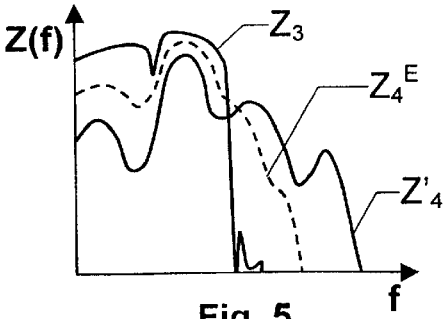
FIG. 5 shows a diagram including a spectrum generated on basis of previous undamaged data, a primary reconstruction of the damaged data respective a secondary reconstruction of the damaged data according to the invention.

FIG. 5 shows a diagram in which an enlarged version of the spectrum $Z_3$ of the decoded acoustic signal based on the latest received undamaged signal frame F(3) and the spectrum $Z'_4$ of the decoded acoustic signal based on the reconstructed signal frame $F_{rec}$(4) are outlined as respective solid lines. A secondary reconstructed spectrum $Z_n^E$ generated by the spectral correction unit 102 is shown in the diagram by means of a dashed line. The spectral shape of the latter spectrum $Z_n^E$ deviates less from the spectrum $Z_3$ of the decoded acoustic signal based on the latest received undamaged signal frame F(3) than the spectrum $Z'_4$ of the decoded acoustic signal based on the reconstructed signal frame $F_{rec}$(4). For instance, the spectrum $Z_n^E$ is more shifted towards the low-frequency region.

Returning to FIG. 1, a second transformer 103 receives the secondary reconstructed spectrum $Z_n^E$, performs an inverse frequency transform and provides a corresponding secondary reconstructed signal $z_n^E$ in the time domain constituting the enhanced decoded signal. FIG. 3 shows this signal $z^E(t_4)$–$z^E(t_5)$ as a dashed line, involving a waveform characteristics, which is more similar to the acoustic signal $z(t_3)$–$z(t_4)$ decoded from the latest received undamaged signal frame F(3) than the acoustic signal $z'(t_4)$–$z'(t_5)$ based on the reconstructed signal frame $F_{rec}$(4).

The secondary reconstructed spectrum $Z_n^E$ is produced by multiplying the phase of the first spectrum $Y_n$, i.e. $Y_n/|Y_n|$ (where $Y_n$ denotes the first spectrum and $|Y_n|$ denotes the magnitude of the first spectrum), corresponding to the reconstructed signal frame $F_{rec}$(4) with a correction spectrum $C_n$. In practice, this can be performed according to the expression: $Z_n^E = C_n \cdot Y_n/|Y_n|$.

According to a preferred embodiment of the invention, the correction spectrum $C_n$ is generated from previously received undamaged data F(n−1) according to the following. The spectral correction unit 102 first generates a previous spectrum $Y_{n-1}$ of a signal produced from the previously received undamaged data F(n−1), corresponding to $Z_3$ in FIGS. 4 and 5 respective F(3) in FIG. 3. Then, the spectral correction unit 102 produces a magnitude spectrum $|Y_{n-1}|$ of the previous spectrum $Y_{n-1}$.

According to another preferred embodiment of the invention the correction spectrum $C_n$ is generated by producing a previous spectrum $Y_{n-1}$ of a signal produced from the previously received undamaged data F(n−1). The resulting spectrum is then filtered into a filtered previous spectrum $H(Y_{n-1})$. Finally, a magnitude spectrum $|H(Y_{n-1})|$ of the filtered previous spectrum $H(Y_{n-1})$ is produced.

The filtering may involve many alternative modifications of the previous spectrum $Y_{n-1}$. The overall purpose of the filtering is, however, always to create a signal with corresponding spectrum, which is a smoothed repetition of the spectrum of the signal decoded from the previous undamaged signal frame. Low-pass filtering therefore constitutes one reasonable alternative. Another alternative would be smoothing in the cepstral domain. This could involve transforming the previous (possibly logarithmic) magnitude spectrum $|Y_{n-1}|$ into the cepstral domain, discarding of cepstral coefficients of a particular order, (say 5–7) and above, and back transforming into the frequency domain. Another non-linear filtering alternative is to divide the previous spectrum $Y_{n-1}$ into at least two frequency sub-bands $f_1$–$f_M$ and calculate an average coefficient value of the original spectral coefficients within the respective frequency sub-band $f_1$–$f_M$. Finally, the original spectral coefficients are replaced by the respective average coefficient value. As a result, the overall frequency band is smoothed. The frequency sub-bands $f_1$–$f_M$ may either be equidistant, i.e. divide the previous spectrum $Y_{n-1}$ into segments of equal size, or be non-equidistant (e.g. according to the Bark or Mel scale band division). A non-equidistant logarithmic division of the spectrum $Y_{n-1}$ is preferable, since also the human hearing is approximately logarithmic with respect to frequency resolution and loudness perception.

Furthermore, the frequency sub-bands may partly overlap each other. Resulting coefficient values in overlapping regions are in this case derived by first, multiplying each frequency sub-band with a window function and second, adding coefficient values of neighbouring windowed frequency sub-bands in each region of overlap. The window function shall have a constant magnitude in non-overlapping frequency regions and a gradually declining magnitude in an upper and a lower transition region where neighbouring frequency sub-bands overlap.

According to another preferred embodiment of the invention, the spectrum of the secondary reconstructed signal $Z_n^E$ is produced by reducing the dynamic range of the correction spectrum $C_n$ relative a so-called target muting spectrum $|Y_0|$.The target muting spectrum $|Y_0|$ may, for instance, represent a long term average value of the acoustic source signal.

A dynamic reduction of the range of the correction spectrum $C_n$ in relation to the target muting spectrum $|Y_0|$ can be performed according to the relationship:

$$C_n=(|Y_0|^k+\mathrm{comp}(|Y_{n-1}|^k-|Y_0|^k))^{1/k}$$

where $Y_{n-1}$ denotes the spectrum of the previously reconstructed signal frame (N.B. this frame need not necessarily be an undamaged signal frame, but may in turn be an earlier reconstructed damaged or lost signal frame), $|Y_0|$ denotes the target muting spectrum, k denotes an exponent, e.g. 2, and comp(x) denotes a compression function. The compression function is characterised by having a smaller absolute value than the absolute value of the input variable, i.e. $|\mathrm{comp}(x)|<|x|$. Thus, a decaying factor $\eta<1$ constitutes a simple example of a compression function $\mathrm{comp}(x)=\eta\cdot x$.

The decaying factor $\eta$ is preferably given by a state machine, which, as in the GSM AMR-standard, may have seven different states. The decaying factor $\eta$ can thus be described as a function of a state variable s, $\eta(s)$, having the following values:

| state (s) | 0 | 1 | 2 | 3 | 4 | 5 | 6 |
|---|---|---|---|---|---|---|---|
| $\eta$ (s) | 1 | 0.98 | 0.98 | 0.98 | 0.98 | 0.98 | 0.7 |

The state variable is set to 0 at reception of an undamaged piece of data. In case of reception of a first piece of damaged data, it is set to 1. If subsequent pieces of damaged data are received after reception of the first piece of damaged data the state variable s is incremented one state for each piece of received damaged data up to a state 6. In the state 6 and at reception of yet another piece of damaged data the state variable remains in state 6. If a piece of an undamaged data is received in the state 6 the state variable is set to state 5, and if in this sate 5 a subsequent piece of undamaged data is received the state variable is reset to 0.

According to another preferred embodiment of the invention, the spectrum of the secondary reconstructed signal $Z_n^E$ is instead produced by reducing the dynamic range of the correction spectrum $C_n$ in relation to a normalised target muting spectrum. This can be effectuated by a calculation of the expression:

$$C_n=\|Y_{n-1}\|\cdot C^s{}_n/\|C^s{}_n\|$$

where $\|Y_{n-1}\|$ denotes an $L_k$-norm of the spectrum of the previously reconstructed signal frame. The $L_k$-norm $\|Y_{n-1}\|$ of a vector $Y_{n-1}=\{Y_1, Y_2, \ldots, Y_m\}$ is given by the expression:

$$\|Y_{n-1}\|=\left(\frac{1}{m}\sum_{i=1}^{m}|y_i|^k\right)^{\frac{1}{k}}$$

where k is an exponent and $y_i$ is the i:th spectral coefficient of $Y_{n-1}$. Furthermore, $C^s{}_n$ is derived according to the relationship:

$$C^s{}_n=(|Y_0|^k/\|Y_0\|^k+\mathrm{comp}(|Y_{n-1}|^k/\|Y_{n-1}\|^k-|Y_0|^k/\|Y_0\|^k))^{1/k}$$

where $|Y_0|$ denotes the target muting spectrum, $\|Y_0\|^k$denotes the power of the target muting spectrum according to the $L_k$-norm used, k is an exponent, e.g. 2, and comp(x) denotes a compression function.

According to a preferred embodiment of the invention the correction spectrum $C_n$ is generated by compressing the magnitude of the spectrum of the previously reconstructed signal frame with respect to a target power $\|Y_0\|^k$according to a linear norm $L_k$, where the exponent k, for instance, equals 2.

In the general case, this compression is achieved by calculating the expression:

$$C_n=|Y_{n-1}|/\|Y_{n-1}\|\cdot(\|Y_0\|^k+\mathrm{comp}(\|Y_{n-1}\|^k-\|Y_0\|^k))^{1/k}$$

where $|Y_{n-1}$ denotes the magnitude of the spectrum of the previously reconstructed signal frame, $\|Y_{0\|}{}^k$denotes the target muting power according to an $L_k$-norm, where k is an exponent, e.g. 2, and comp(x) denotes a compression function.

According to a preferred embodiment of the invention the correction spectrum $C_n$ is described by the relationship:

$$C_n=\eta\cdot|Y_{n-1}|$$

where $\eta$ denotes a decaying factor<1, and $|Y_{n-1}|$ denotes the magnitude of the spectrum of the previously reconstructed signal frame.

Also in this case the decaying factor $\eta$ is preferably given by a state machine having seven different states, 0–6. Furthermore, the same values of $\eta(s)$ and rules of the state machine as above may be applied.

According to a preferred embodiment of the invention the correction spectrum $C_n$ is generated by first producing the spectrum $Y_{n-1}$ of the previously reconstructed signal frame. Then, producing the corresponding magnitude spectrum $|Y_{n-1}|$, and finally multiplying a part m (i.e. an m:th sub-band) of the magnitude spectrum $|Y_{n-1}|$ with an adaptive muting factor $\gamma_m$. One simple example is to use only one band (i.e. m=1) containing the complete spectrum.

The adaptive muting factor $\gamma_m$ may in turn be derived from the previously reconstructed signal frame and the received damaged data F(n) according to the expression:

$$\gamma_m=\frac{\sqrt{\sum_{k=low(m)}^{high(m)}|Y_n(k)|^2}}{\sqrt{\sum_{k=low(m)}^{high(m)}|Y_{n-1}(k)|^2}}$$

where "low(m)" denotes a frequency coefficient index corresponding to a lower frequency band boundary of a sub-band $f_m$ of a spectrum of the signal having been decoded from reconstructed data, "high(m)" denotes a frequency coefficient index corresponding to an upper frequency band boundary of a sub-band $f_m$ of a spectrum of the signal having been decoded from reconstructed data, $|Y_n(k)|$ denotes the magnitude of a coefficient representing a k:th frequency component in the first spectrum, and $|Y_{n-1}(k)|$ denotes the magnitude of a coefficient representing a k:th frequency component in the previous spectrum.

Moreover, it is not necessary to sub-divide the spectrum. Thus, the spectrum may only comprise one sub-band $f_m$, having coefficient indices corresponding to the boundaries of the entire frequency band of the signal decoded from reconstructed data. If, however, a sub-band division is made, it should preferably accord with the Bark scale band division or the Mel scale band division.

According to a preferred embodiment of the invention, the correction spectrum $C_n$ exclusively influences frequency components above a threshold frequency. For reasons of implementation, this threshold frequency is chosen such as it corresponds to a particular threshold coefficient. The correction spectrum $C_n$ can hence be described by the expressions:

$$C_n(k)=|Y_n(k)| \text{ for } k\leqq\text{the threshold coefficient}$$

$$C_n(k)=\gamma\cdot|Y_{n-1}(k)| \text{ for } k>\text{the threshold coefficient}$$

where $C_n(k)$ denotes the magnitude of a coefficient k representing a k:th frequency component in the correction spectrum $C_n$, $|Y_n(k)|$ denotes the magnitude of a coefficient k representing a k:th frequency component in the first spectrum, $|Y_{n-1}(k)|$ denotes the magnitude of a coefficient representing a k:th frequency component in the previous spectrum and $\gamma$ denotes an adaptive muting factor<1.

The adaptive muting factor $\gamma$ may, for instance, be chosen as the square-root of the ratio between the power $|Y_n|^2$ of the first spectrum $Y_n$ and the power $|Y_{n-1}|^2$ of the previous spectrum $Y_{n-1}$, i.e.:

$$\gamma=\frac{\sqrt{|Y_n|^2}}{\sqrt{|Y_{n-1}|^2}}$$

The adaptive muting factor $\gamma$, may also be derived for a particular frequency band according to the expression:

$$\gamma=\frac{\sqrt{\sum_{k=low}^{high}|Y_n(k)|^2}}{\sqrt{\sum_{k=low}^{high}|Y_{n-1}(k)|^2}}$$

where "low" denotes a frequency coefficient index corresponding to a lower frequency band boundary of the spectrum of a signal having been decoded from reconstructed data, "high" denotes a frequency coefficient index corresponding to an upper frequency band boundary of the spectrum of a signal having been decoded from reconstructed data, $|Y_n(k)|$ denotes the magnitude of a coefficient representing a k:th frequency component in the first spectrum, and $|Y_{n-1}(k)|$ denotes the magnitude of a coefficient representing a k:th frequency component in the previous spectrum. Typically, the lower frequency band boundary may be 0 kHz and the upper frequency band boundary 2 kHz. The threshold frequency in the expressions for describing the correction spectrum $C_n(k)$ above may, but need not, coincide with the upper frequency band boundary. According to a preferred embodiment of the invention the threshold frequency is instead 3 kHz.

Since the primary error concealment unit generally is most effective in the lower part of the frequency band, the proposed muting action is also most effective in this band. Thus, by in the first spectrum $Y_n$ forcing the ratio between the high frequency band power and the low frequency band power to be identical to the corresponding ratio of the previous signal frame the muting from the primary error concealment unit can be extended also to the higher part of the frequency band.

It is a common feature in state-of-the-art error concealment methods to limit the power level of the first frame after a lost or damaged frame to the power level of the latest received undamaged signal frame before the error/loss occurred. Also according to the present invention it is advantageous adapt a similar principle and thus limit the power of a sub-band of the correction spectrum $C_n$ to the power of a corresponding sub-band of a previously received undamaged data F(n−1). The sub-bands can, for example, be defined as coefficients representing frequency components above a threshold frequency (represented by the threshold coefficient k). Such magnitude limitation namely ensures that the high to low frequency band energy ratio is not falsified in the first frame after a frame erasure. The magnitude limitation can be described by the expression:

$$C_n(k)=\min\left(1,\frac{\sigma_{h,prevgood}}{\sigma_{h,n}}\right)\cdot|Y_n(k)|$$

for $k\leqq$the threshold coefficient where $\sigma_{h,prevgood}$ denotes the root of the power of a signal frame derived from the latest received undamaged signal frame F(N−1), $\sigma_{h,n}$ denotes the root of the power of a signal frame derived from a current signal frame and $|Y_n(k)|$ denotes the magnitude of a coefficient k representing a k:th frequency component in a spectrum derived from the current signal frame.

Since the invention is mainly intended to be used in relation to encoding of speech signals the primary reconstructed signal is preferably an acoustic signal. Furthermore, the encoded speech data is segmented into signal frames, or more precisely so-called speech codec frames. The speech codec frames may also be further divided into speech codec sub-frames, which likewise may constitute the basis for the operation of the error concealment unit according to the invention. Damaged data is then determined on basis of whether a particular speech codec or speech codec sub-frame is lost or received with at least one error.

Figure 6:
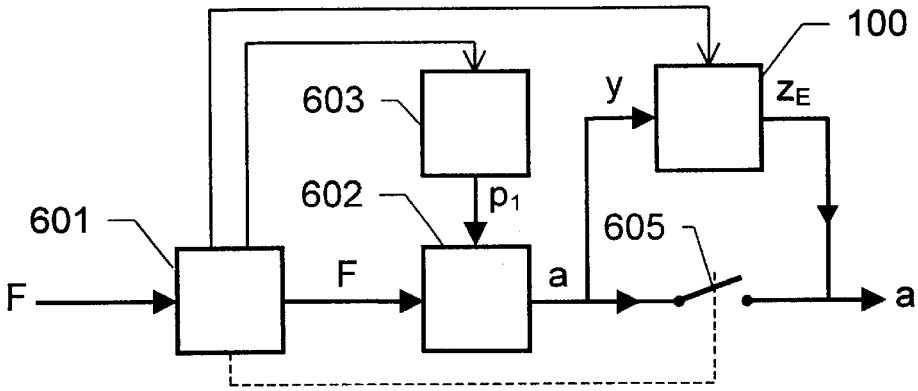
FIG. 6 shows a block diagram over a first embodiment of an error concealment unit according to the invention.

FIG. 6 shows a block diagram over a CELP-decoder including an error concealment unit 100 to which an acoustic signal a is fed as the primary reconstructed signal y.

The decoder includes a primary error concealment unit 603, which produces at least one parameter $p_1$, in case a damaged speech frame F is received or if a speech frame F is lost. A data quality determining unit 601 checks all incoming speech frames F, e.g. by performing to a cyclic redundancy check (CRC), to conclude whether a particular speech frame F is correctly or erroneously received. Undamaged speech frames F are passed through the data quality determining unit 601 to a speech decoder 602, which generates an acoustic signal a on its output and via a closed switch 605.

If the data quality determining unit 601 detects a damaged or lost speech frame F the unit 601 activates the primary error concealment unit 603 that produces at least one parameter $p_1$representing a basis for a first reconstruction of the damaged speech frame F. The speech decoder 602 then generates the first reconstructed speech signal a in response to the reconstructed speech frame. The data quality determining unit 601 also activates the error concealment unit 100 and opens the switch 605. Thus, the first reconstructed speech signal a is passed as a signal y to the error concealment unit 100 for further enhancement of the acoustic signal a according to the proposed methods above. A resulting enhanced acoustic signal a is delivered on the output as a signal $Z_E$, being spectrally adjusted such that its spectrum deviates less with respect to spectral shape from an acoustic signal a produced from a previously received undamaged speech frame F than the spectrum of the first reconstructed speech signal.

Figure 7:
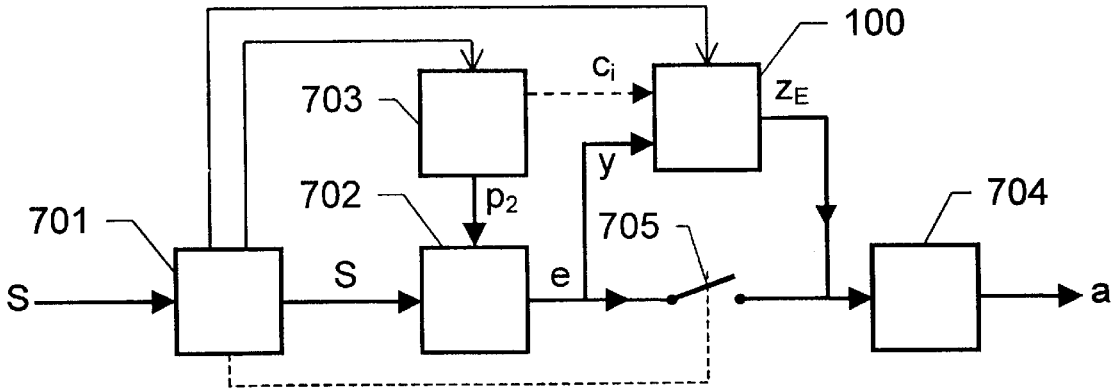
FIG. 7 shows a block diagram over a second embodiment of an error concealment unit according to the invention.

FIG. 7 shows a block diagram over another application of an error concealment unit according to the invention. Here, a data quality determining unit 701 receives incoming parameters S representing important characteristics of an acoustic source signal. In case the parameters S are undamaged (determined e.g. by CRC), they are passed on to an excitation generator 702. The excitation generator 702 delivers an excitation signal e via a switch 705 to a synthesis filter 704, which generates an acoustic signal a.

If, however, the data quality determining unit 701 finds that the parameters S are damaged or lost it activates a primary error concealment unit 703, which produces at least one parameter $p_2$. The excitation generator 702 receives the at least one parameter $p_2$ and provides in response thereto a first reconstructed excitation signal e. The data quality determining unit 701 also opens the switch 705 and activates the error concealment unit 100. As a consequence of this, the excitation signal e is received by the error concealment unit 100 as a primary reconstructed signal y. The error concealment unit 100 generates in response thereto a secondary reconstructed signal $Z_E$, being spectrally adjusted such that its spectrum deviates less with respect to spectral shape from an excitation signal e produced from a previously received undamaged speech frame F than the spectrum of the first reconstructed excitation signal.

According to preferred embodiment of the invention, the primary error concealment unit 703 also passes at least one parameter $c_i$ to the error concealment unit 100. This transfer is controlled by the data quality determining unit 701.

Figure 8:
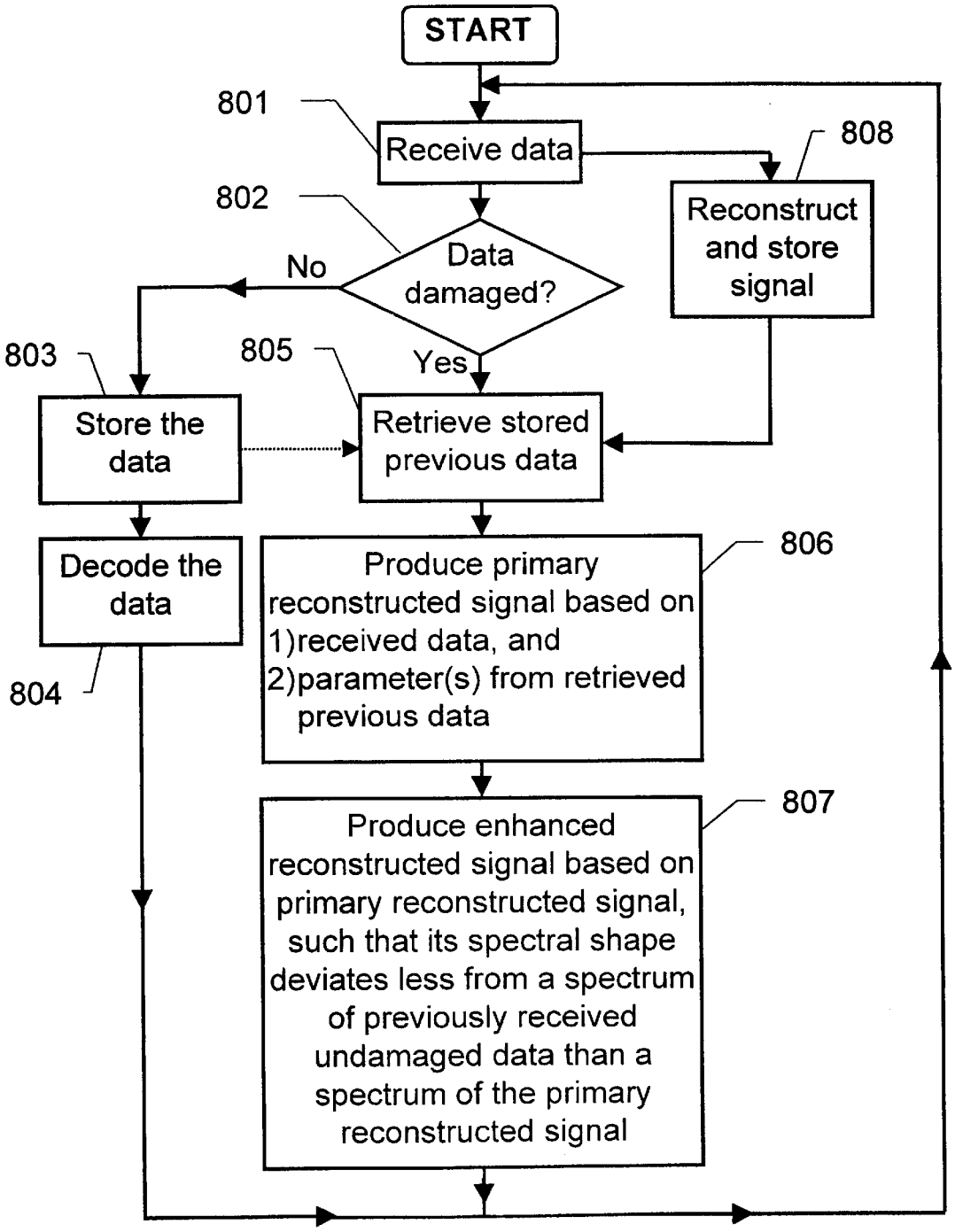
FIG. 8 illustrates in a flow diagram the general method according to the invention.

In order to sum up, the general method of the invention will now be described with reference to a flow diagram in FIG. 8. Data is received in a first step 801. A subsequent step 802 checks whether the received data is damaged or not, and if the data is undamaged the procedure continues to a step 803. This step stores the data for possible later use. Then, in a following step 804, the data is decoded into an estimate of either the source signal itself, a parameter or a signal related to the source signal, such as an excitation signal. After that, the procedure returns to the step 801 for reception of new data.

If the step 802 detects that the received data is damaged the procedure continues to a step 805 where the data previously stored in step 803 is retrieved. Since, in fact, many consecutive pieces of data may be damaged or lost, the retrieved data need not be data that immediately precede the currently lost or damaged data. The retrieved is nevertheless the latest received undamaged data. This data is then utilised in a subsequent step 806, which produces a primary reconstructed signal. The primary reconstructed signal is based on the currently received data (if any) and at least one parameter of the stored previous data. Finally, a step 807 generates a secondary reconstructed signal on basis of the primary reconstructed signal such that the spectral shape deviates less from a spectrum of the previously received undamaged data than a spectrum of the primary reconstructed signal. After that, the procedure returns to the step 801 for reception of new data.

Another possibility is to include a step 808, which generates and stores data based on the presently reconstructed frame. This data can be retrieved in step 805 in case of a further immediately following frame erasure.

The method above, as well as any of the other described embodiments, of the invention may be performed by a computer program directly loadable into the internal memory of a computer. Such a program comprises software for performing the proposed steps when said program is run on the computer. The computer may naturally also be stored onto any kind of readable medium.

Moreover, it is envisaged to be advantageous to co-locate an error concealment unit 100 according to the invention with a so-called enhancement unit for speech codecs, which performs filtering in the frequency domain. Both these units namely operate in a similar manner in the frequency domain and involve a reverse frequency transformation into the time domain.

Even though the secondary reconstructed signal above has been proposed to be produced by use of a correction magnitude spectrum $C_n$ obtained by performing filtering operations in the frequency domain the same filtering may, of course, equally well be performed in the time domain by instead using a corresponding time domain filter. Any known design method is then applicable to derive such a filter having a frequency response, which approximates the correction magnitude spectrum $C_n$.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures, but may be varied freely within the scope of the claims.

What is claimed is:

1. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the spectrum of the secondary reconstructed signal is derived according to the expression: $C_n \cdot Y_n / |Y_n|$ where:

$C_n$ denotes the correction spectrum, $Y_n$ denotes the first spectrum $|Y_n|$ denotes the magnitude of the first spectrum.

2. A method according to claim 1, wherein the spectrum of the previously reconstructed signal is produced from previously received undamaged data.

3. A method according to claim 1, wherein the primary reconstructed signal and the secondary reconstructed signal are acoustic signals.

4. A method according to claim 1, wherein the primary reconstructed signal and the secondary reconstructed signal are excitation signals.

5. A method according to claim 1, wherein the data is segmented into signal frames and damaged data is determined on basis of whether a particular signal frame is lost or received with at least one error.

6. A method according to claim 5, wherein the signal frame constitutes a speech codec frame.

7. A method according to claim 5, wherein the signal frame constitutes a speech codec sub-frame.

8. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal wherein the spectral adjustment involves multiplication of a phase spectrum of the first spectrum generated from the reconstructed data with a correction spectrum, and wherein the correction spectrum is produced by producing a previous spectrum of a previously reconstructed signal, and producing a magnitude spectrum of the previous spectrum.

9. A method according to claim 8, wherein the spectrum of the previously reconstructed signal is produced from previously received undamaged data.

10. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal wherein the spectral adjustment involves multiplication of a phase spectrum of the first spectrum generated from the reconstructed data with a correction spectrum, and wherein the correction spectrum is produced by producing a previous spectrum of a signal produced from the previously received undamaged data, producing a filtered previous spectrum by filtering the previous spectrum, and producing a magnitude spectrum of the filtered previous spectrum.

11. A method according to claim 10, wherein the filtering involves low-pass filtering.

12. A method according to claim 10, wherein the filtering involves smoothing in the cepstral domain.

13. A method according to claim 10, wherein the filtering involves:

dividing previous spectrum into at least two frequency sub-bands;

calculating for each frequency sub-band an average coefficient value of original spectral coefficients within the respective frequency sub-band; and replacing, for each frequency sub-band, each of the original spectral coefficients with the respective average coefficient value.

14. A method according to claim 13, wherein the frequency sub-bands are equidistant.

15. A method according to claim 13, wherein the frequency sub-bands are at least partly overlapping.

16. A method according to claim 15, wherein resulting coefficient values in overlapping regions of the frequency sub-bands are derived by:

producing corresponding windowed frequency sub-bands by multiplying each frequency sub-band with a window function; and adding coefficient values of neighboring windowed frequency sub-bands in each region of overlap.

17. A method according to claim 16, wherein the window function has a constant magnitude in non-overlapping frequency regions and has a gradually declining magnitude in an upper and a lower transition region where neighboring frequency sub-bands overlap.

18. A method according to claim 13, wherein the previous spectrum and the first spectrum respectively are divided into at least two frequency sub-bands according to the Bark scale band division.

19. A method according to claim 13, wherein the previous spectrum and the first spectrum respectively are divided into at least two frequency sub-bands according to the Mel scale band division.

20. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal wherein the spectral adjustment involves multiplication of a phase spectrum of the first spectrum generated from the reconstructed data with a correction spectrum, and wherein the spectrum of the secondary reconstructed signal is produced by reducing a dynamic range of the correction spectrum relative a target muting spectrum.

21. A method according to claim 20, further comprising producing the correction spectrum according to the relationship:

$$(|Y_0|^k+\mathrm{comp}(|Y_{n-1}|^k-|Y_0|^k))^{1/k}$$

where:

$Y_{n-1}$ denotes the spectrum of a previously reconstructed signal frame, $|Y_0|$ denotes the target muting spectrum, k denotes an exponent, and comp(x) denotes a compression function, such that $|\text{comp}(x)|<|x|$.

22. A method according to claim 21, wherein the compression function is a decaying function described by the expression: $\eta \cdot x$ where:

$\eta$ denotes a decaying factor<1, and x denotes the value to be compressed.

23. A method according to claim 22, wherein the decaying factor $\eta$ is given by a state machine having seven states and is described by the expression: $\eta(s)$; where $\eta(s)$ depending on the state variables, which is given by $$\eta(s)=1 \text{ for } s=0$$

$$\eta(s)=0.98 \text{ for } s\epsilon[1,5]$$

$$\eta(s)=0.7 \text{ for } s=6,$$

and the state variable being set to 0 at reception of an undamaged data, the state variable being set to 1 at reception of a piece of damaged data, the state variable being incremented one state for each piece of subsequently received damaged data after reception of the first piece of damaged data, and in state 6, at reception of a damaged data the state variable remaining equal to 6, and at reception of an undamaged data the state variable being set to state 5.

24. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal. wherein the spectral adjustment involves multiplication of a phase spectrum of the first spectrum generated from the reconstructed data with a correction spectrum, and wherein the spectrum of the secondary reconstructed signal is produced by reducing the dynamic range of the correction spectrum relative a normalized target muting spectrum.

25. A method according to claim 24, further comprising producing the correction spectrum according to the relationship:

$$\|Y_{n-1}\| \cdot C^s{}_n / \|C^s{}_n\|$$

where:

$\|Y_{n-1}\|$ denotes an $L_k$-norm of the spectrum of the previously reconstructed signal frame, $$C^s{}_n = (|Y_0|^k / \|Y_0\|^k + \text{comp}(|Y_{n-1}|^k / \|Y_{n-1}\|^k - |Y_0|^k / \|Y_0\|^k))^{1/k}$$

where:

$|Y_0|$ denotes a target muting spectrum, $\|Y_0\|^k$ denotes the power of the target muting spectrum according to the $L_k$-norm, k denotes an exponent, and comp(x) denotes a compression function, such that $|\text{comp}(x)|<|x|$.

26. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal wherein the spectral adjustment involves multiplication of a phase spectrum of the first spectrum generated from the reconstructed data with a correction spectrum, and wherein the correction spectrum is produced by compressing the magnitude of a previous spectrum of a previously reconstructed signal with respect to the power of a target muting spectrum.

27. A method according to claim 26, further comprising producing the correction spectrum according to the relationship:

$$|Y_{n-1}| / \|Y_{n-1}\| \cdot (\|Y_0\|^k + \text{comp}(\|Y_{n-1}\|^k - \|Y_0\|^k))^{1/k}$$

where:

$|Y_{n-1}|$ denotes the magnitude of the spectrum of a previously reconstructed signal frame, $\|Y_0\|^k$ denotes an $L_k$-norm of the target muting spectrum, k denotes an exponent, and comp(x) denotes a compression function, such that $|\text{comp}(x)|<|x|$.

28. A method according to claim 27, further comprising producing the correction spectrum according to the relationship:

$$\eta \cdot |Y_{n-1}|$$

where $\eta$ denotes a decaying factor<1, and $|Y_{n-1}|$ denotes the magnitude of the spectrum of the previously reconstructed signal frame.

29. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal wherein the spectral adjustment involves multiplication of a phase spectrum of the first spectrum generated from the reconstructed data with a correction spectrum, and wherein the correction spectrum is produced by producing a spectrum of a previously reconstructed signal frame, producing a magnitude of the spectrum of the previously reconstructed signal frame, and multiplying at least one frequency band of the magnitude spectrum with at least one adaptive muting factor, the at least one adaptive muting factor being derived from the previously reconstructed signal frame, and is produced with respect to at least one frequency sub-band of a spectrum of the previously reconstructed signal frame.

30. A method according to claim 29, wherein one of the at least one adaptive muting factor is derived according to the expression:

$$\frac{\sqrt{\sum_{k=low(m)}^{high(m)} |Y_n(k)|^2}}{\sqrt{\sum_{k=low(m)}^{high(m)} |Y_{n-1}(k)|^2}}$$

where:

"low(m)" denotes a frequency coefficient index corresponding to a lower frequency band boundary of a sub-band, $f_m$, of a spectrum of a signal having been decoded from reconstructed data, "high(m)" denotes a frequency coefficient index corresponding to an upper frequency band boundary of a sub-band, $f_m$, of a spectrum of a signal having been decoded from reconstructed data, $|Y_n(k)|$ denotes the magnitude of a coefficient representing a k:th frequency component in the first spectrum, and $|Y_{n-1}(k)|$ denotes the magnitude of a coefficient representing a k:th frequency component in the previous spectrum.

31. A method of receiving data in the form of encoded information from a transmission medium and decoding the data into an acoustic signal, the method in case of lost or received damaged data comprising:

producing reconstructed data on basis of at least one parameter of previously reconstructed signal;

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal wherein the spectral adjustment involves multiplication of a phase spectrum of the first spectrum generated from the reconstructed data with a correction spectrum, and wherein the correction spectrum is exclusively influenced frequency components above a threshold frequency, corresponding to a particular threshold coefficient.

32. A method according to claim 31, wherein the correction spectrum is described by the expressions:

$$C_n(k)=|Y_n(k)| \text{ for } k \leqq \text{the threshold coefficient}$$

$$C_n(k)=\gamma\cdot|Y_{n-1}(k)| \text{ for } k<\text{the threshold coefficient}$$

where $C_n(k)$ denotes the magnitude of a coefficient representing a k:th frequency component in the correction spectrum, $|Y_n(k)|$ denotes the magnitude of a coefficient representing a k:th frequency component in the first spectrum, $|Y_{n-1}(k)|$ denotes the magnitude of a coefficient representing a k:th frequency component in the previous spectrum and $\gamma_m$ denotes an adaptive muting factor<1.

33. A method according to claim 32, wherein the adaptive muting factor is derived according to the expression:

$$\frac{\sqrt{\sum_{k=low}^{high} |Y_n(k)|^2}}{\sqrt{\sum_{k=low}^{high} |Y_{n-1}(k)|^2}}$$

where:

"low" denotes a frequency coefficient index corresponding to a lower frequency band boundary of the spectrum of a signal having been decoded from reconstructed data, "high" denotes a frequency coefficient index corresponding to an upper frequency band boundary of the spectrum of a signal having been decoded from reconstructed data, $|Y_n(k)|$ denotes the magnitude of a coefficient representing a k:th frequency component in the first spectrum, and $|Y_{n-1}(k)|$ denotes the magnitude of a coefficient representing a k:th frequency component in the previous spectrum.

34. A method according to claim 31, wherein the power of at least one sub-band of the correction spectrum is limited to the power of at least one sub-band of a previously received undamaged data for coefficients representing frequency components above the threshold frequency.

35. A computer program directly loadable into the internal memory of a computer, comprising software for performing the steps of claim 1 when said program is run on the computer.

36. A computer readable medium, having a program recorded thereon, where the program is to make a computer perform the steps of claim 1.

37. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein:

the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal, wherein the spectral correction unit multiplies a phase spectrum of the primary reconstructed frequency transform with a correction spectrum. and wherein the secondary reconstructed spectrum is derived according to the expression: $C_n \cdot Y_n / |Y_n|$ where: $C_n$ denotes the correction spectrum, $Y_n$ denotes the first spectrum $|Y_n|$ denotes the magnitude of the first spectrum.

38. An error concealment unit according to claim 37, wherein the spectrum of the previously reconstructed signal is produced from previously received undamaged data.

39. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment unit having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal wherein the spectral adjustment involves multiplication of a phase spectrum of the first spectrum with a correction spectrum and wherein the spectrum of the enhanced acoustic signal is derived according to the expression: $C_n \cdot Y_n / |Y_n|$ where: $C_n$ denotes the correction spectrum, $Y_n$ denotes the first spectrum $|Y_n|$ denotes the magnitude of the first spectrum.

40. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal, wherein the spectral correction unit multiplies a phase spectrum of the primary reconstructed frequency transform with a correction spectrum, and wherein the correction spectrum is produced by producing a previous spectrum of a previously reconstructed signal, and producing a magnitude spectrum of the previous spectrum.

41. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal;

wherein the spectral correction unit multiplies a phase spectrum of the primary reconstructed frequency transform with a correction spectrum, and wherein the correction spectrum is produced by producing a previous spectrum of a signal produced from previously received undamaged data, producing a filtered previous spectrum by filtering the previous spectrum, and producing a magnitude spectrum of the filtered previous spectrum.

42. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein:

the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal;

wherein the spectral correction unit multiples a phase spectrum of the primary reconstructed frequency transform with a correction spectrum, and wherein the spectrum of the secondary reconstructed signal is produced by reducing a dynamic range of the correction spectrum relative a target muting spectrum.

43. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein:

the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal;

wherein the spectral correction unit multiplies a phase spectrum of the primary reconstructed frequency transform with a correction spectrum, and wherein the spectrum of the secondary reconstructed signal is produced by reducing the dynamic range of the correction spectrum relative a normalized target muting spectrum.

44. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein:

the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal;

wherein the spectral correction unit multiples a phase spectrum of the primary reconstructed frequency transform with a correction spectrum, and wherein correction spectrum is produced by compressing the magnitude of a previous spectrum of a previously reconstructed signal with respect to the power of a target muting spectrum.

45. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein:

the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal;

wherein the spectral correction unit multiplies a phase spectrum of the primary reconstructed frequency transform with a correction spectrum, the correction spectrum is produced by producing a spectrum of a previously reconstructed signal frame, producing a magnitude of the spectrum of the previously reconstructed signal frame, and multiplying at least one frequency band of the magnitude spectrum with at least one adaptive muting factor, the at least one adaptive muting factor being derived from the previously reconstructed signal frame, and is produced with respect to at least one frequency sub-band of a spectrum of the previously reconstructed signal frame.

46. An error concealment unit for enhancing a signal decoded from received data in the form of encoded information in case of lost data or received damaged data, the unit comprising:

a first transformer having an input to receive a primary reconstructed signal decoded from the received data and an output to provide a primary reconstructed frequency transform;

a spectral correction unit having an input to receive the primary reconstructed frequency transform and an output to provide a secondary reconstructed spectrum; and a second transformer having an input to receive the secondary reconstructed spectrum and an output to provide a secondary reconstructed signal, wherein:

the spectral correction unit produces the secondary reconstructed spectrum signal on basis of the primary reconstructed signal such that the secondary reconstructed spectrum signal deviates less with respect to spectral shape from a spectrum of a previously reconstructed signal than a spectrum based on the primary reconstructed signal;

wherein the spectral correction unit multiplies a phase spectrum of the primary reconstructed frequency transform with a correction spectrum, and wherein the correction spectrum exclusively influences frequency components above a threshold frequency, corresponding to a particular threshold coefficient.

47. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, wherein the spectral adjustment involves multiplication of a phase spectrum of the first spectrum with a correction spectrum, wherein the correction spectrum is produced by producing a previous spectrum of a previously reconstructed signal, and producing a magnitude spectrum of the previous spectrum.

48. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment unit having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, wherein the spectral adjustment involves multiplication of a phase spectrum of the first spectrum with a correction spectrum, and wherein the correction spectrum is produced by producing a previous spectrum of a signal produced from the previously received undamaged data, producing a filtered previous spectrum by filtering the previous spectrum, and producing a magnitude spectrum of the filtered previous spectrum.

49. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, wherein the spectral adjustment involves multiplication of a phase spectrum of the first spectrum with a correction spectrum, and wherein the spectrum of the enhanced acoustic signal is produced by reducing a dynamic range of the correction spectrum relative a target muting spectrum.

50. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment unit having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, wherein the spectral adjustment involves multiplication of a phase spectrum of the first spectrum with a correction spectrum, and wherein the spectrum of the enhanced acoustic signal is produced by reducing the dynamic range of the correction spectrum relative a normalized target muting spectrum.

51. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment unit having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, wherein the spectral adjustment involves multiplication of a phase spectrum of the first spectrum with a correction spectrum, and wherein the correction spectrum is produced by compressing the magnitude of a previous spectrum of a previously reconstructed signal with respect to the power of a target muting spectrum.

52. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, wherein the spectral adjustment involves multiplication of a phase spectrum of the first spectrum with a correction spectrum, and wherein the correction spectrum is produced by producing a spectrum of a previously reconstructed signal frame, producing a magnitude of the spectrum of the previously reconstructed signal frame, and multiplying at least one frequency band of the magnitude spectrum with at least one adaptive muting factor, the at least one adaptive muting factor being derived from the previously reconstructed signal frame, and is produced with respect to at least one frequency sub-band of a spectrum of the previously reconstructed signal frame.

53. A decoder for generating an acoustic signal from received data in the form of encoded information, comprising:

a primary error concealment unit to produce at least one parameter via an output;

a speech decoder having a first input to receive speech codec frames, a second input to receive the at least one parameter and an output to provide an acoustic signal in response to the at least one parameter; and an error concealment unit having an input which receives the acoustic signal, wherein the error concealment unit produces an enhanced acoustic signal on basis of the acoustic signal by performing a spectral adjustment of a first spectrum of the acoustic signal such that a spectrum of the enhanced acoustic signal deviates less with respect to spectral shape than the first spectrum from a spectrum of a previously reconstructed signal, and wherein the correction spectrum is produced by producing a previous spectrum of a previously reconstructed signal, and producing a magnitude spectrum of the previous spectrum, wherein the correction spectrum exclusively influences frequency components above a threshold frequency, corresponding to a particular threshold coefficient.

54. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by producing a previous spectrum of a previously reconstructed signal, and producing a magnitude spectrum of the previous spectrum.

55. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by producing a previous spectrum of a signal produced from the previously received undamaged data, producing a filtered previous spectrum by filtering the previous spectrum, and producing a magnitude spectrum of the filtered previous spectrum.

56. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the spectrum of the secondary reconstructed signal is produced by reducing a dynamic range of the correction spectrum relative a target muting spectrum.

57. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the spectrum of the secondary reconstructed signal is produced by reducing the dynamic range of the correction spectrum relative a normalized target muting spectrum.

58. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by compressing the magnitude of a previous spectrum of a previously reconstructed signal with respect to the power of a target muting spectrum.

59. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by producing a spectrum of a previously reconstructed signal frame, producing a magnitude of the spectrum of the previously reconstructed signal frame, and multiplying at least one frequency band of the magnitude spectrum with at least one adaptive muting factor, the at least one adaptive muting factor being derived from the previously reconstructed signal frame, and is produced with respect to at least one frequency sub-band of a spectrum of the previously reconstructed signal frame.

60. A computer program directly loadable into the internal memory of a computer, comprising software for performing the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum exclusively influences frequency components above a threshold frequency, corresponding to a particular threshold coefficient.

61. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by producing a previous spectrum of a previously reconstructed signal, and producing a magnitude spectrum of the previous spectrum.

62. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by producing a previous spectrum of a signal produced from the previously received undamaged data, producing a filtered previous spectrum by filtering the previous spectrum, and producing a magnitude spectrum of the filtered previous spectrum.

63. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the spectrum of the secondary reconstructed signal is produced by reducing a dynamic range of the correction spectrum relative a target muting spectrum.

64. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the spectrum of the secondary reconstructed signal is produced by reducing the dynamic range of the correction spectrum relative a normalized target muting spectrum.

65. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by compressing the magnitude of a previous spectrum of a previously reconstructed signal with respect to the power of a target muting spectrum.

66. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum is produced by producing a spectrum of a previously reconstructed signal frame, producing a magnitude of the spectrum of the previously reconstructed signal frame, and multiplying at least one frequency band of the magnitude spectrum with at least one adaptive muting factor, the at least one adaptive muting factor being derived from the previously reconstructed signal frame, and is produced with respect to at least one frequency sub-band of a spectrum of the previously reconstructed signal frame.

67. A computer readable medium, having a program recorded thereon, where the program is to make a computer perform the steps of:

producing a primary reconstructed signal from the reconstructed data, the primary reconstructed signal having a first spectrum; and producing a secondary reconstructed signal on basis of the primary reconstructed signal by performing a spectral adjustment of the first spectrum such that a spectrum of the secondary reconstructed signal deviates less with respect to spectral shape than the first spectrum from a spectrum of a previously reconstructed signal, wherein the spectral adjustment involves multiplication of a phase spectrum of the first spectrum generated from the reconstructed data with a correction spectrum, and wherein the correction spectrum exclusively influences frequency components above a threshold frequency, corresponding to a particular threshold coefficient.

* * * * *